US009771702B2

(12) United States Patent
Han

(10) Patent No.: US 9,771,702 B2
(45) Date of Patent: Sep. 26, 2017

(54) MANHOLE WITH HEIGHT/INCLINATION-ADJUSTABLE MANHOLE COVER

(71) Applicant: Byungsook Han, Chungcheongbuk-do (KR)

(72) Inventor: Byungsook Han, Chungcheongbuk-do (KR)

( * ) Notice: Subject to any disclaimer, the term of this patent is extended or adjusted under 35 U.S.C. 154(b) by 0 days.

(21) Appl. No.: 14/888,619

(22) PCT Filed: Jun. 4, 2014

(86) PCT No.: PCT/KR2014/004975
§ 371 (c)(1),
(2) Date: Nov. 2, 2015

(87) PCT Pub. No.: WO2014/196813
PCT Pub. Date: Dec. 11, 2014

(65) Prior Publication Data

US 2016/0090708 A1 Mar. 31, 2016

(30) Foreign Application Priority Data

Jun. 4, 2013 (KR) ..... 10-2013-0063881

(51) Int. Cl.
*E02D 29/14* (2006.01)
*E02D 29/12* (2006.01)

(52) U.S. Cl.
CPC ..... *E02D 29/1409* (2013.01); *E02D 29/121* (2013.01); *E02D 29/14* (2013.01)

(58) Field of Classification Search
CPC . E02D 29/1409; E02D 29/14; E02D 29/1427; E02D 29/149
USPC ..... 409/25, 26
See application file for complete search history.

(56) References Cited

U.S. PATENT DOCUMENTS 2,749,999 A * 6/1956 Schmid ..... E03F 5/0407 137/362
3,832,438 A * 8/1974 Ditcher ..... B28B 23/0043 249/145
4,038,789 A * 8/1977 Axgarde et al. .... E02D 29/1409 285/404
4,582,450 A * 4/1986 Neil ..... E02D 29/1409 404/26

(Continued)

FOREIGN PATENT DOCUMENTS

KR 20-0211307 11/2000
KR 20-0450118 8/2010

OTHER PUBLICATIONS

International Search Report (ISR) dated Jun. 26, 2014 in PCT/KR2014/004975.

*Primary Examiner* — Justin Rephann
(74) *Attorney, Agent, or Firm* — Harness, Dickey & Pierce, P.L.C.

(57) ABSTRACT

The present disclosure relates to a manhole with a manhole cover that can be adjusted in height and inclination in the entire structure. A manhole with a height/inclination-adjustable manhole cover includes: a manhole cover; a cover base closing the top of the manhole cover and having a pipe shape; a support having a pipe shape and radially overlapping the cover base; and an insertion disposed between the cover base and the support in the radial direction of the cover base and preventing movement of the cover base relative to the support through a wedge effect.

4 Claims, 4 Drawing Sheets

(56) References Cited

U.S. PATENT DOCUMENTS

| | | | | | |
|---|---|---|---|---|---|
| 5,188,402 | A * | 2/1993 | Colgate et al. | F16J 15/0881 | 220/304 |
| 5,451,119 | A * | 9/1995 | Hondulas | E02D 29/1463 | 404/25 |
| 5,470,172 | A * | 11/1995 | Wiedrich | E02D 29/1409 | 404/25 |
| 5,974,741 | A * | 11/1999 | Fukuhara | E02D 29/1409 | 404/25 |
| 5,987,824 | A * | 11/1999 | Fuller | E02D 29/14 | 404/25 |
| 6,161,984 | A * | 12/2000 | Sinclair | E02D 29/1427 | 404/25 |
| 6,371,688 | B1 * | 4/2002 | Yang et al. | E02D 29/1409 | 404/26 |
| 6,457,901 | B1 * | 10/2002 | Sondrup | E02D 29/1445 | 404/25 |
| 2004/0013466 | A1 * | 1/2004 | Sondrup | E02D 29/1445 | 404/26 |
| 2007/0062125 | A1 * | 3/2007 | Gondou | E02D 29/14 | 52/19 |
| 2009/0214292 | A1 * | 8/2009 | Crissman | E02D 29/14 | 404/26 |
| 2010/0124458 | A1 * | 5/2010 | Munro | E02D 29/12 | 404/26 |
| 2012/0297691 | A1 * | 11/2012 | Gaspar | E02D 29/14 | 49/505 |
| 2013/0312338 | A1 * | 11/2013 | Gaspar | E02D 29/12 | 52/19 |

* cited by examiner

MANHOLE WITH HEIGHT/INCLINATION-ADJUSTABLE MANHOLE COVER

CROSS-REFERENCE TO RELATED APPLICATIONS

This application is a national phase application of PCT Application No. PCT/KR2014/004975, filed on 4 Jun. 2014, which claims benefit of Korean Patent Application 10-2013-0063881, filed on 4 Jun. 2013. The entire disclosure of the applications identified in this paragraph are incorporated herein by references.

FIELD

The present disclosure relates to a manhole with a height/inclination-adjustable manhole cover, particularly, a manhole cover of which the height and inclination can be adjusted by a wedge.

BACKGROUND

This section provides a general summary of the disclosure and is not a comprehensive disclosure of its full scope or all of its features.

In general, manholes or examination holes are formed at predetermined locations to work such as repair or replacement of pipes or electric wires for waterworks, sewerages, communication, and city gas under the ground, and cover bases and manhole covers are installed and fixed at the entrance of the manholes and examination holes for workers to be able to get under the ground to examine those facilities.

However, those manhole covers cannot be adjusted in height and inclination, so it is required to specifically adjust the heights in order to level the tops of the cover bases and the surfaces of roads, and accordingly, a large amount of manhole covers on roads are a main factor that make the roads bumpy.

In detail, industrial manholes are circular or rectangular concrete structure and are composed of a manhole body connected with channels and an examination hole formed through the top of the manhole body for people or machines can pass it to work, and a manhole cover is installed over the examination hole.

That is, a manhole cover is supposed to be disposed over a manhole and fixed to be leveled with the surface of a road, but it is difficult to adjust the manhole cover, so a base for adjusting height is separately installed under the manhole cover to adjust height.

According to the existing manholes, however, the surfaces of roadways are damaged by vehicles for the specific characteristics of the roadways, so they are necessarily repaired, for example, by pavement, but when the surface of a road becomes higher or lower due to repair work, it is impossible to effectively adjust the height of a manhole cover.

Further, it is impossible to finely adjust the inclination and height of a manhole.

Accordingly, there is a need for developing a manhole cover of which the height and inclination can be variously adjusted to solve these problems.

DISCLOSURE

Technical Problem

An object of the present disclosure is to provide a manhole with a high/inclination-adjustable manhole cover allowing for easy adjustment of the height and inclination of a manhole.

Technical Solution

This section provides a general summary of the disclosure and is not a comprehensive disclosure of its full scope or all of its features.

According to one aspect of the present disclosure, a manhole with a height/inclination-adjustable manhole cover includes: a manhole cover; a cover base closing the top of the manhole cover and having a pipe shape; a support having a pipe shape and radially overlapping the cover base; and an insertion disposed between the cover base and the support in the radial direction of the cover base and preventing movement of the cover base relative to the support through a wedge effect.

According to one aspect of the present disclosure, the cover base has: a cover portion having a recessed groove for coupling the manhole cover at the upper end; and an inserting portion extending downward from the cover portion, having a lower portion bending inward, and radially overlapping the cover base, with a lower portion fitted in an upper portion of the support, in which the insertion is fitted between the outer side of the inserting portion and the inner side of the support.

According to one aspect of the present disclosure, the insertion divides a vertical force applied by the manhole cover and the cover base into a vertical component force and a horizontal component force and couples the inserting portion and the support using the horizontal component force.

According to one aspect of the present disclosure, the insertion is made of an elastic or plastic material and has a wedge shape that becomes thinner as it goes upward.

According to one aspect of the present disclosure, the insertion is a closed loop to be inserted around the inserting portion.

According to one aspect of the present disclosure, the lower end inner diameter of the cover base is larger than the upper end outer diameter of the support and the lower end of the cover base is fitted on the upper end of the support such that the cover base can vertically move. The insertion is made of an elastic material and fitted on the outer side of the support and a coupling portion on the inner side of the cover base to fix the cover base, and the cover base has an inclined portion at the lower end having an inner diameter, which increases as it goes downward, and the insertion is in close contact upward through the inner side of the inclined portion.

According to one aspect of the present disclosure, the insertion has any one cross-section selected from a wedge shape, a circle, and a polygon.

Advantageous Effects

According to an aspect of the present disclosure, since by adjusting the height and inclination of an insertion and inserting it in the cover base and then inserting a wedge between the cover base and the insertion, it is possible to accurately adjust height and inclination to coincide with them of a road in initial installation, and it is possible to easily adjust the height and inclination of the manhole, if necessary, such as repairing of a road.

Further, according to an aspect of the present disclosure, the vertical load applied by the cover base and the insertion is divided into vertical and horizontal component forces and the wedge is tightened by the horizontal component force larger than the vertical component force, so the cover base and the manhole can be very firmly fixed.

Further, according to an aspect of the present disclosure, the wedge is made of an elastic or plastic material and becomes thinner as it goes upward, so it can be easily inserted in between the inner side of the cover base and the outer side of the insertion.

Further, according to an aspect of the present disclosure, the cover base has prominences and depressions on the inner side to prevent separation of the wedge, so it is possible to easily prevent the wedge from separating downward.

BEST MODE

The present disclosure will now be described in detail with reference to the accompanying drawing(s).

However, limited embodiments are exemplified to help clearly understand the spirit described below, but the present disclosure is not limited thereto and it should be noted that modifications that can be easily achieved by those skilled in the art from the spirit described in claims should be construed as being included in the embodiments described herein.

Further, terminologies used herein were selected for convenience of description by the inventor(s), so the meanings should be appropriately construed to meet the spirit of the present disclosure without being limited to the meanings in dictionaries.

Figure 1:
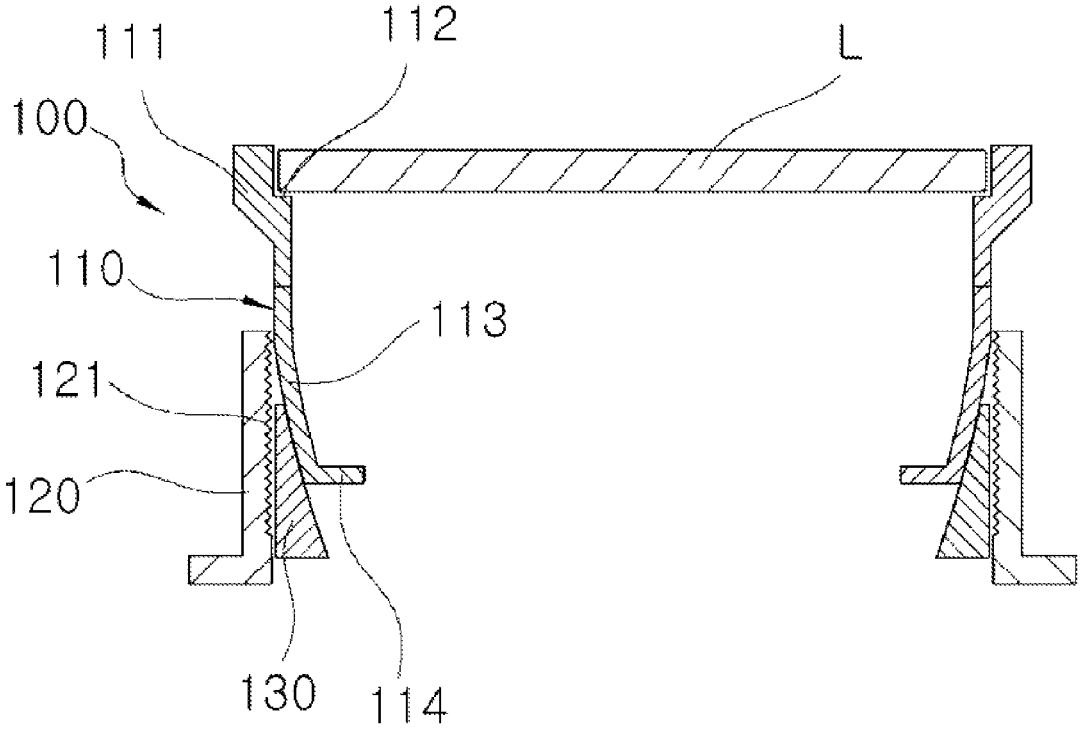
FIG. 1 is a cross-sectional view illustrating a manhole with a height/inclination-adjustable manhole cover according to an embodiment of the present disclosure.
Figure 2:
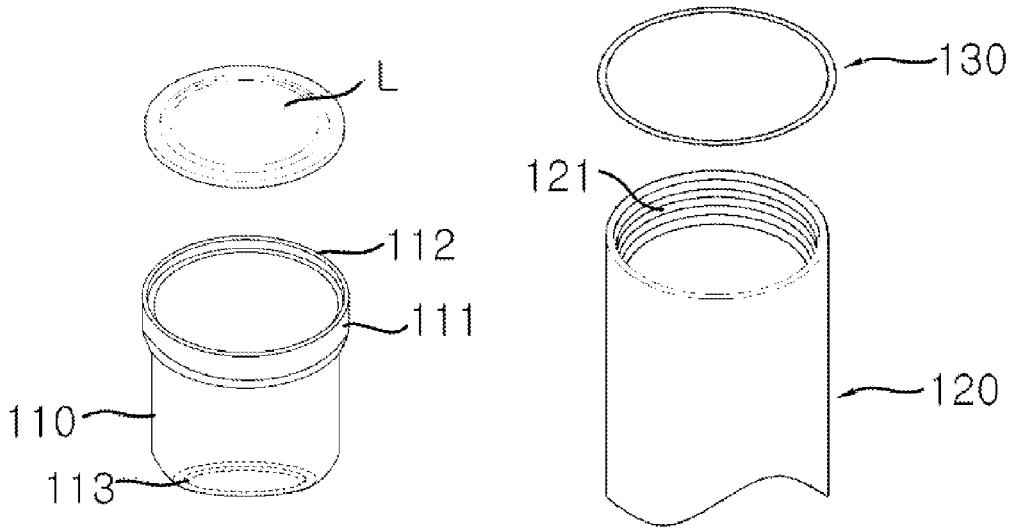
FIG. 2 is an assembly view illustrating the manhole with a height/inclination-adjustable manhole cover according to an embodiment of the present disclosure.
Figure 3:
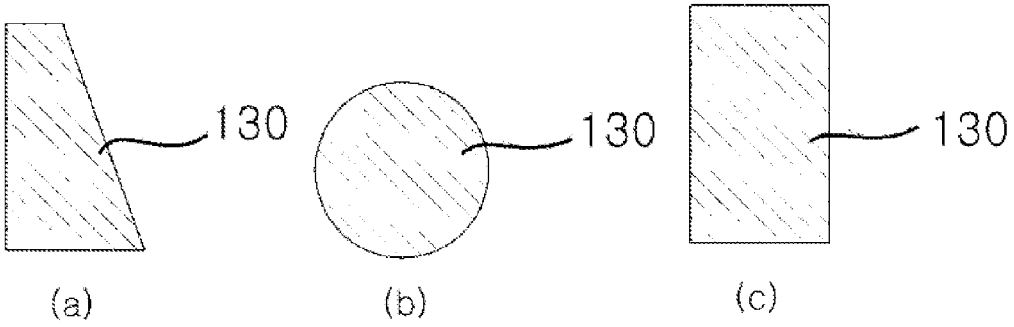
FIG. 3 is a view illustrating various modifications of the wedge illustrated in FIG. 1.

FIG. 1 is a cross-sectional view illustrating a manhole with a height/inclination-adjustable manhole cover according to an embodiment of the present disclosure, FIG. 2 is an assembly view illustrating the manhole with a height/inclination-adjustable manhole cover according to an embodiment of the present disclosure, and FIG. 3 is a view illustrating various modifications of the wedge illustrated in FIG. 1.

Referring to FIGS. 1 to 3, a manhole 100 with a height/inclination-adjustable manhole cover L according to an embodiment includes a manhole cover L, a cover base 110, a support 120, and an insertion 130.

The cover base 110 closes the top of the manhole cover L and has a pipe shape.

The support 120 overlaps the cover base 110 in the radial direction of the cover base 110 and has a pipe shape.

The cover base 110 and the support 120 are not limited to the pipe shapes having a circular cross-section and may have pipe shapes having polygonal cross-sections.

The insertion 130 is disposed between the cover base 110 and the support 120 in the radial direction of the cover base 110 and prevents the cover base 110 from moving with respect to the support 120 through a wedge effect.

The insertion 130 may have various vertical cross-sections, as illustrated in FIG. 3, and may have a ring shape as in FIG. 2, but a plurality of insertions may be provided.

The support 120 may have a hollow cylindrical shape and its inside may wide as it goes upward so that the cover base 110 can be simply inserted in the support 120.

Further, the support 120 may be made of metal and may be coated with a material for preventing corrosion. The material for preventing corrosion may be graphene.

Graphene is chemically inactive and its chemical state is not changed up to 400° C.

The cover base 110 has a cover portion 111 and an inserting portion 113 for adjusting the height and inclination of a manhole.

The cover portion 111 may have a hollow cylindrical shape and has a recessed groove 112 formed around the upper inner side to hold the manhole cover L.

The recessed groove 112 may be formed to correspond to the lower end of the manhole cover L.

The inserting portion 113 is connected to the lower portion of the cover portion 111 and has a lower portion bending inside, so it is inserted in the support 120 such that height and inclination can be adjusted. In detail, the lower outer side of the inserting portion 113 is inserted in the upper inside of the support 120 such that height and inclination can be adjusted.

The inclination is adjusted to correspond to the inclination of a road, using the gap between the support 120 and the cover base 110.

A plurality of inserting portions 113 may be circumferentially connected around the cover portion 111 under the cover portion 111.

The insertion 130 may be formed in the shape of a tripod and is disposed between the inner side of the support 120 and the outer side of the insertion 113, and the inserting portion 113 is firmly fixed and supported through the insertion 130 by a horizontal component force larger than a vertical component force due to downward load applied by the manhole cover L and the inserting portion 113.

The insertion 130 may be made of an elastic or plastic material and may be thinner as it goes upward.

It can more firmly fix and support the inserting portion 113 by being plastically transformed in a corresponding shape between the inner side of the support 120 and the outer side of the inserting portion 113.

Accordingly, it is possible to simply separate the insertion 130 only by lifting up the cover base 110. Therefore, according to the manhole 100 with a height/inclination-adjustable manhole cover L of the present embodiment, by adjusting height and inclination of the inserting portion 113 and inserting the insertion portion into the support 120 and then by inserting and tightening the insertion 130 between the support 120 and the inserting portion 113, it is possible to easily adjust the height and inclination of the manhole cover L every time a road is repaired. Further, the insertion 130 receives downward load applied by the support 120 and the inserting portion 113 and is tightened between the support 120 and the inserting portion 113 by the load and a vertical component force, so the cover base and the manhole can be firmly supported.

Further, in this embodiment, since the insertion 130 is made of an elastic or plastic material and becomes thinner as it goes upward, the insertion can be easily inserted and tightened between the inner side of the support 120 and the outer side of the inserting portion 113.

Further, in this embodiment, the support 120 may have prominences and depressions 121 on the inner side.

The prominences and depressions 121 have convex portions and concave portions repeatedly formed and prevent separation of the insertion 130.

Further, the insertion 130 may be plastically transformed to correspond to the prominences and depressions 121.

In this embodiment, the inserting portion 113 may have a protruding step 114 on the inner side.

The protruding step 114 may be formed at the lower end of the inserting portion 113.

The protruding step 114 prevents the inserting portion 113 from breaking by distributing the component force applied to the inserting portion 113 by the insertion 130.

Figure 4:
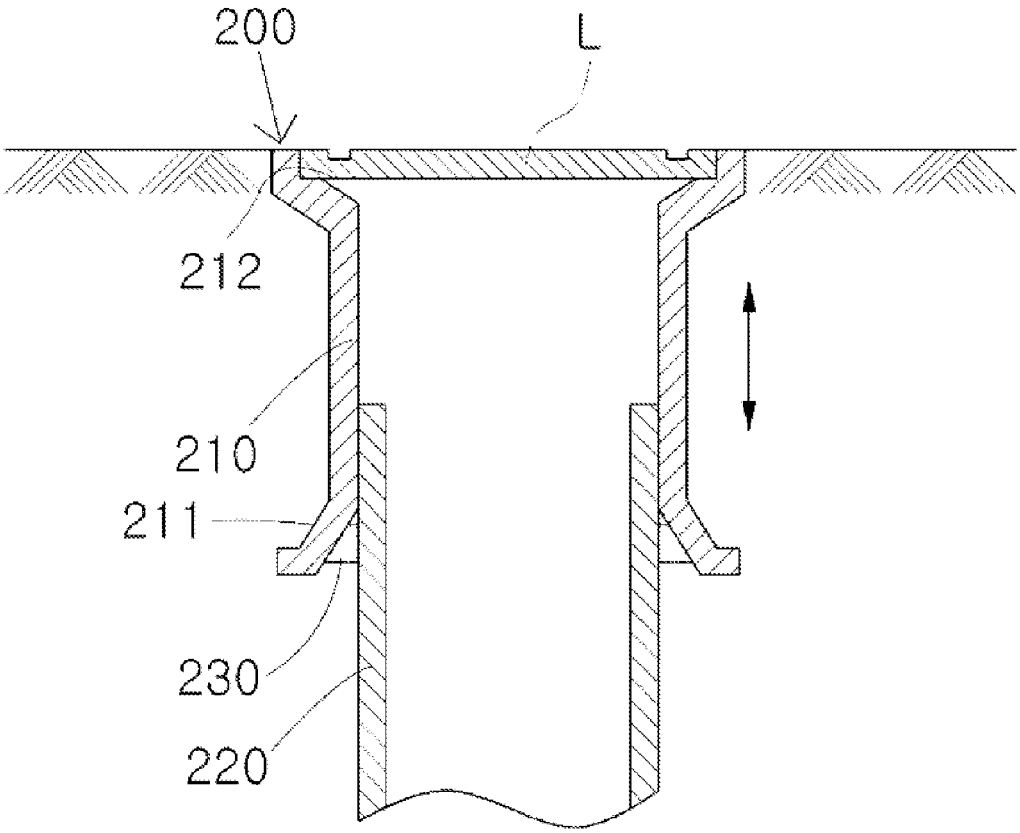
FIG. 4 is a cross-sectional view illustrating a manhole with a height/inclination-adjustable manhole cover according to another embodiment of the present disclosure.

FIG. 4 is a cross-sectional view illustrating a manhole with a height/inclination-adjustable manhole cover according to another embodiment of the present disclosure.

Referring to FIG. 4, a manhole 200 with a height/inclination-adjustable manhole cover is a little different in configuration from the manhole described above, but is greatly different in that the lower end inner diameter of a cover base 210 is larger than the upper end outer diameter of the support 220, the lower end of the cover base 210 is fitted on the upper end of the support 220 such that the cover base 210 can vertically move, an insertion 230 is made of an elastic material and fitted on the outer side of the support 220 and a coupling portion 211 on the inner side of the cover base 210 to fix the cover base 210, the cover base 210 has an inclined portion 213 at the lower end having an inner diameter, which increases as it goes downward, and an insertion 230 is in close contact upward through the inner side of the inclined portion 213.

The embodiment is available for manhole covers with a small outer diameter such as the manholes for waterworks, and city gas.

What is claimed is:

1. A manhole with a height and inclination adjustable manhole cover, comprising:

the manhole cover;

a cover base closing the top of the manhole cover and having a pipe shape with a circular cross-section;

a support having a hollow cylindrical pipe shape and radially overlapping the cover base; and an insertion disposed between the cover base and the support in the radial direction of the cover base and preventing movement of the cover base relative to the support, wherein the cover base comprises:

a cover portion having a recessed groove for coupling the manhole cover at an upper end of the cover base; and an inserting portion extending downward from the cover portion, having a lower portion bending inward, and overlapped by the support in the radial direction of the cover base, with the lower portion fitted in an upper portion of the support, wherein the insertion is fitted between an outer side of the inserting portion and an inner side of the support, wherein the insertion is made of an elastic or plastic material and has a wedge shape that becomes thinner as it goes upward, wherein the insertion is a closed loop to be inserted around the inserting portion, wherein an inclination of the cover base is adjusted to correspond to an inclination of a road, using a gap between the support and the cover base, and wherein the inserting portion has a protrusion step formed inward at a lower end of the inserting portion.

2. The manhole of claim 1, wherein the insertion has any one cross-section selected from a wedge shape, a circle, and a polygon.

3. The manhole of claim 1, wherein the insertion divides a vertical force applied by the manhole cover and the cover base into a vertical component force and a horizontal component force and couples the inserting portion and the support using the horizontal component force.

4. The manhole of claim 1, wherein the protrusion step prevents the inserting portion from breaking by distributing a component force applied to the inserting portion by the insertion.

* * * * *